United States Patent [19]

Strichman et al.

[11] Patent Number: 4,564,401

[45] Date of Patent: Jan. 14, 1986

[54] METHOD FOR PRODUCING IRON-SILICON ALLOY ARTICLES

[75] Inventors: George A. Strichman, New Rochelle, N.Y.; Edward J. Dulis, Pittsburgh; Kalatur S. V. L. Narasimhan, Monroeville, both of Pa.; Thomas Lizzi, Zelienople, Pa.

[73] Assignee: Crucible Materials Corporation, Pittsburgh, Pa.

[21] Appl. No.: 537,135

[22] Filed: Sep. 29, 1983

[51] Int. Cl.[4] ..... H01F 1/02

[52] U.S. Cl. ..... 148/104; 148/105; 148/111; 419/23; 419/48; 419/49

[58] Field of Search ..... 75/0.5 C; 148/104, 105, 148/110, 111; 419/23, 48, 49; 264/12

[56] References Cited

U.S. PATENT DOCUMENTS

| | | | |
|---|---|---|---|
| 2,825,095 | 3/1958 | Heck | 75/0.5 BA |
| 2,878,518 | 3/1959 | Klee | 75/0.5 BA |
| 2,988,806 | 6/1961 | Adams et al. | 148/104 |
| 3,306,742 | 2/1967 | Adams et al. | 148/105 |
| 3,661,570 | 5/1972 | Moss | 148/104 |
| 3,676,610 | 7/1972 | Moss et al. | 148/104 |
| 3,814,598 | 6/1974 | Gabriel et al. | 419/48 |
| 4,101,348 | 7/1978 | Berchtold | 419/48 |
| 4,177,089 | 12/1979 | Bankson | 148/105 |

FOREIGN PATENT DOCUMENTS

| | | | |
|---|---|---|---|
| 715014 | 8/1965 | Canada | 75/0.5 C |
| 798269 | 7/1958 | United Kingdom | 75/0.5 BA |

*Primary Examiner*—John P. Sheehan

*Attorney, Agent, or Firm*—Finnegan, Henderson, Farabow, Garrett & Dunner

[57] ABSTRACT

A method for producing iron-silicon alloy articles having an improved combination of hot workability and electrical properties; the method comprises taking a molten alloy mass of an iron-silicon alloy from which the article is to be made and gas atomizing it to form alloy particles which are quickly cooled to solidification temperature. These alloy particles are then hot isostatically pressed to form a substantially fully dense article. The fully dense article is then hot rolled to sheet form suitable for example for use as laminates in the manufacture of transformer cores.

19 Claims, 4 Drawing Figures

METHOD FOR PRODUCING IRON-SILICON ALLOY ARTICLES

Iron-silicon alloys are conventionally used in electrical applications such as power transformers, generators, motors and the like. Iron-silicon alloys of this type typically have silicon contents on the order of 3 to 4%. The silicon content of the alloy in electrical applications, such as transformer cores, permits cyclic variation of the applied magnetic field with limited energy loss, which is termed core loss. Core loss may be defined as the hysteresis loss plus the eddy current loss. Eddy current losses are inversely proportional to the electrical resistivity of the iron-silicon alloy and therefore the higher the resistivity the lower the eddy current loss and thus the core loss. Hysteresis loss is the residual magnetism remaining in the core as the alternating current goes through its cycle. A measure of hysteresis is the coercivity of the material.

It is well known that increased silicon contents in iron-silicon alloys benefit these magnetic properties; however, as silicon is increased it embrittles the alloy and specifically impairs the hot-workability thereof. Typically iron-silicon alloys are hot rolled and thereafter cold rolled to final gauge with a series of intermediate anneals. It has been found that with silicon contents substantially greater than about 4% the iron-silicon alloy will exhibit cracking during hot rolling.

It is accordingly a primary object of the present invention to provide a method for producing iron-silicon alloy articles having high silicon contents and thus improved electrical properties, and yet may be rolled to the final gauges necessary for use in electrical applications, such as laminates suitable for the use in the manufacture of transformer cores.

A more specific object of the invention is to provide a method for producing iron-silicon alloy articles wherein increased silicon contents may be provided to result in improved electrical properties while maintaining good hot workability, so that the iron-silicon alloy may be rolled to conventional sheet form for use in electrical applications, such as laminates suitable for use in the manufacture of transformer cores.

Figure 1C:
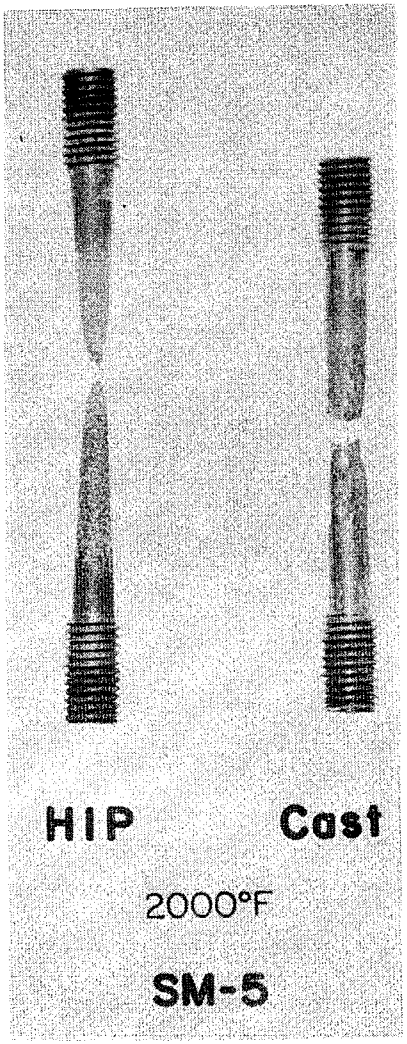
Figure 1B:
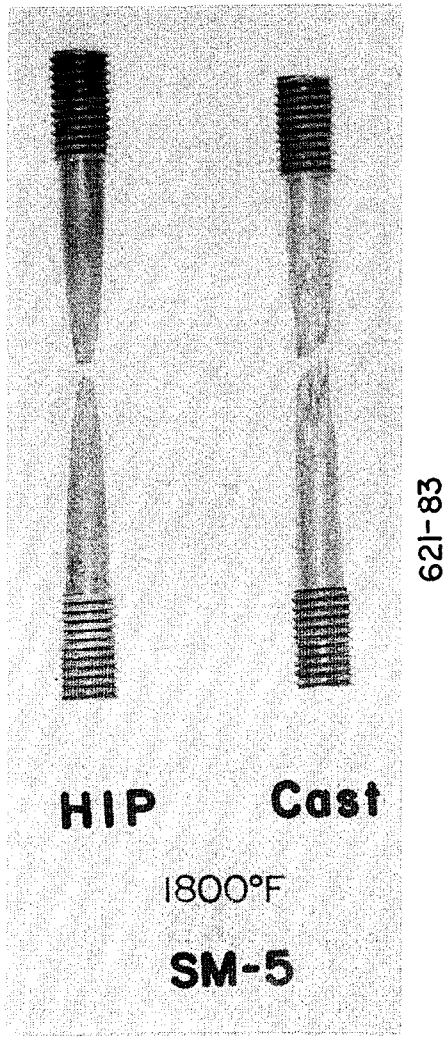
Figure 1A:
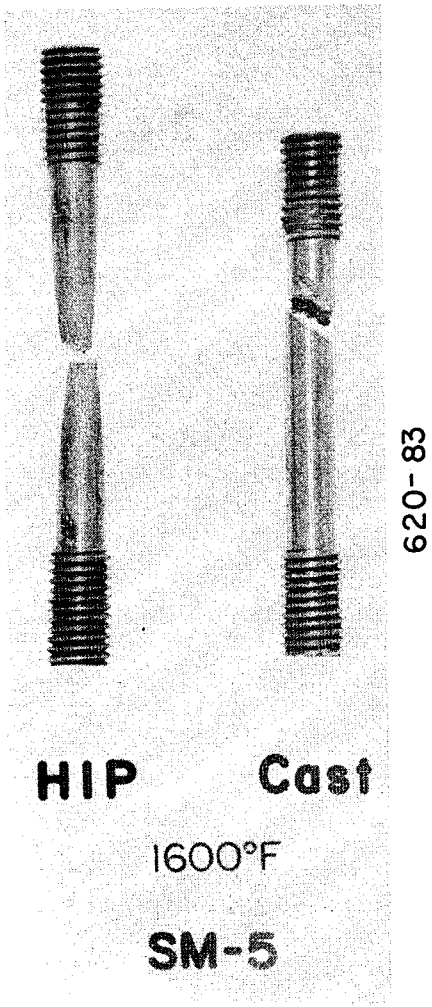
Figure 2:
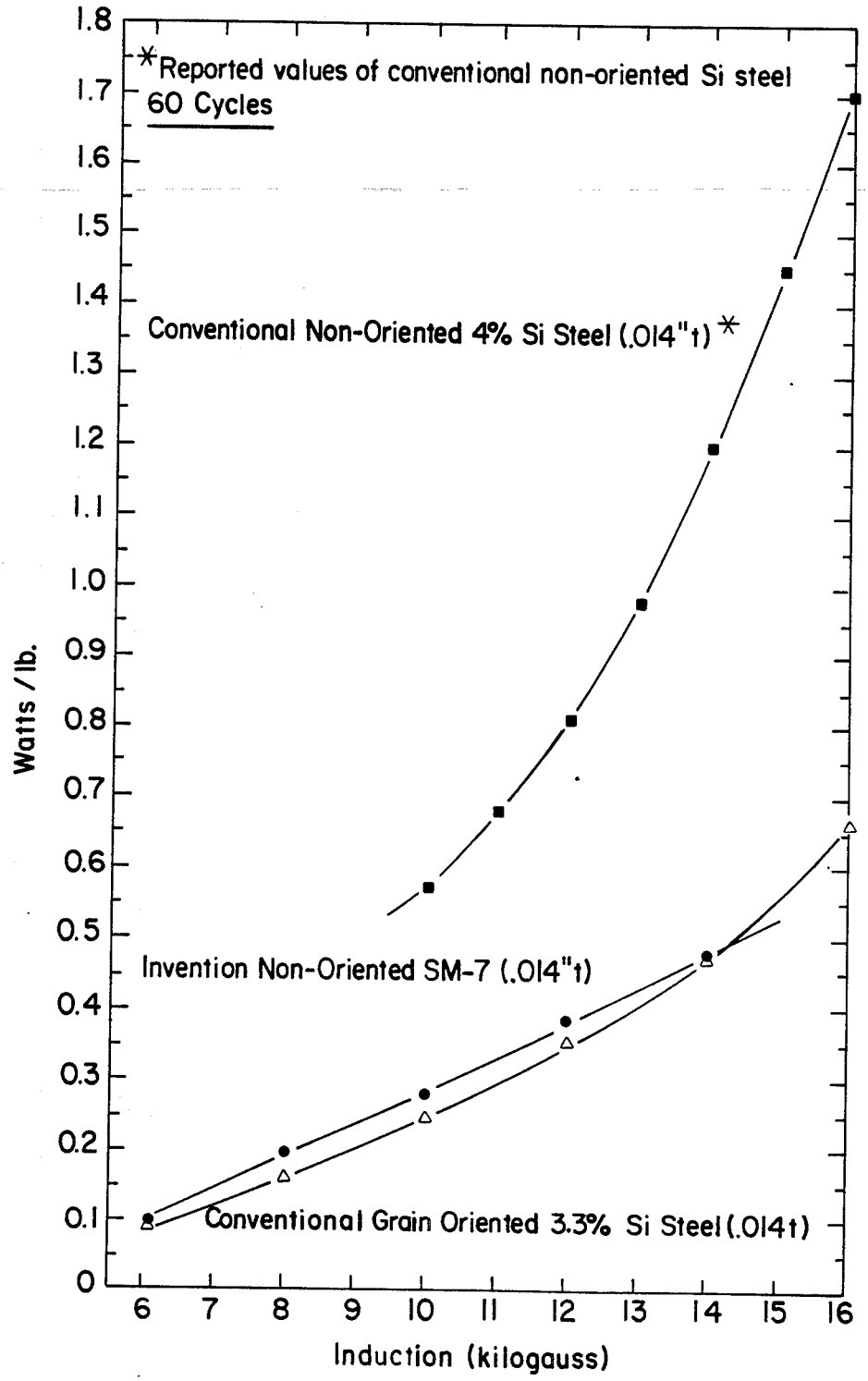

These and other objects of the invention, as well as a more complete understanding thereof, may be obtained from the following description, specific examples and drawings, in which:

FIG. 1*a–c* is a series of photographs showing elongation and fracture mode in tensile specimens; and FIG. 2 is a series of curves comparing the core loss values of conventional nonoriented iron-silicon alloy with non-oriented iron-silicon alloy produced in accordance with the method of the invention.

Broadly, the method of the invention comprises forming a molten alloy mass of an iron-silicon alloy composition from which it is desired to make a final article, such as a sheet suitable for use as laminates in the manufacture of transformer cores. The molten alloy mass is gas atomized, such as with the use of argon gas, to form particles that are rapidly cooled to solidification temperature. Thereafter the particles are in the conventional manner hot isostatically pressed to form a substantially fully dense article. Because of the rapid solidification of the particles the microstructure of the particles is uniform and free from segregation. By the use of hot isostatic compacting of these particles, the consolidated article likewise has a uniform microstructure substantially the same as that of the particles. Consequently, as will be demonstrated hereinafter, as a result of this uniform microstructure higher than normal silicon contents may be present in the iron-silicon alloy compositions processed in accordance with the invention and workability will not be impaired thereby.

In the conventional practice wherein ingot casting is used in the manufacture of iron-silicon alloys, the relatively slow cooling throughout the cross-sectional area of the casting results in the formation of relative large segregates of non-metallics and alloying constituents in the microstructure. These segregates during subsequent hot rolling in the presence of silicon contents greater than about 4% result in cracking of the alloy workpiece. Specifically, the presence of silicon results in an overall embrittlement of the alloy matrix, and the presence of the segregates in the alloy microstructure provides sites for crack propagation through this brittle structure. With the uniform microstructure achieved with the practice of the invention, however, segregates are essentially absent and thus sites for crack propagation during working are substantially eliminated. Consequently, it is possible for a higher-silicon containing alloy with a more brittle matrix to be effectively rolled to sheet thickness within the range of 0.2 to 0.009 inch suitable for electrical applications, such as laminates for the manufacture of transformer cores.

During gas atomization the particles are cooled at a rate of about 100° to 100,000° C. per second. This may be contrasted with solidification rates in conventional ingot casting which may range from 0.1° to 0.001° C. per second. Typically, in accordance with the invention, the alloy particle sizes upon atomization are within the size range of about 850 to less than 50 microns. Silicon contents may be present in the atomized alloy in accordance with the invention within the range of 5 to 10% by weight. In addition, the alloy may contain nickel up to 4.0% by weight and cobalt up to 4% by weight, either singly or in combination. Typically, the alloy will contain aluminum within the range of 1.5 to 6% by weight whether or not nickel and/or cobalt is present. In addition, grain boundary pinning agents such as titanium boride, manganese sulfide and titanium sulfide could be used. As will be shown and discussed in more detail hereinafter, the addition of grain boundary pinning agents serves to further improve hot workability. These grain boundary pinning agents may be present within the range of 0.1 to 1.0% by weight.

Typically for use in electrical applications, the consolidated article in accordance with the invention would be hot rolled to hot rolled band gauge within the range of 0.25 to 0.02 inch at a temperature within the range of 1600° to 2100° F. Thereafter the hot rolled material would be rolled to final gauge at temperatures of 700° to 1000° F.

By way of specific example to demonstrate the improvement with respect of hot workability achieved with the practice of the invention, as compared with conventional ingot casting, an iron-silicon alloy identified as Alloy SM-5 having 3.3% silicon, balance iron was produced by conventional ingot casting which included the steps of:

(1) Induction melting a 30-pound heat of the alloy.

(2) Casting the molten alloy into a split cast-iron mold with a hot top. The mold was lined with a three-inch layer of refractory to provide a slower cool to the ingot to simulate approximately the cooling rate of a larger ingot.

(3) The solidified ingot was removed from the mold after it reached approximately room temperature.

The same alloy was produced in accordance with the present invention by induction melting a 300-pound heat of a composition similar to that of the cast composition. The molten alloy was then tapped into a tundish in the bottom of which was a nozzle for permitting a controlled stream to enter the atomizing chamber. As the molten stream entered the atomizing chamber, it was impacted by high pressure argon gas and atomized into fine particles. These particles rapidly cooled and ranged in sizes below 30 microns to 800 microns. The particles were screened to −30 mesh and then placed in a steel container. The container was next vacuum outgassed and sealed. The particle-filled container was then placed in an autoclave, heated to 2060° F. and hot isostatically pressed at a pressure of some 15,000 psi. Samples of alloy produced in accordance with conventional ingot casting and in accordance with the practice of the invention were tested to determine the relative hot workability under the following testing conditions. Longitudinal tensile specimens were machined from the as-cast ingot and tensile specimens of the same configuration were machined from the hot isostatically pressed material. Briefly, the rapid strain rate and rapid heating rate test used to evaluate hot workability simulates the actual hot working rate in hot rolled sheet product. The test involves threading the tensile test specimen into a fixture and then applying a current to heat the specimen by resistance. The heat-up time to test temperature takes between two to three minutes; the specimen was soaked at this temperature for two minutes, and then the load applied at a strain rate of 500–550 inches per inch per minute until fracture occurs. In this test, the mode of fracture and reduction of area are the indicators of the hot workability at the various temperatures of the test. The results of these tests are shown on Table I and FIG. 1.

TABLE I

HIGH STRAIN RATE TENSION TEST DATA
Comparing Cast to Atomized/HIPed
Fe—3.3% Si) SM-5

| Alloy | Material | Temp. (°F.) | Ultimate Tensile Strength (psi) | Reduction of Area (%) | Mode of Fracture |
|---|---|---|---|---|---|
| SM-5 | Cast | 1600 | 21,100 | * | Brittle |
| | HIP | 1600 | 18,100 | 68.3 | Ductile |
| | Cast | 1800 | 10,700 | * | Partially Ductile |
| | HIP | 1800 | 10,300 | 90.6 | Ductile |
| | Cast | 2000 | 6,500 | * | Ductile |
| | HIP | 2000 | 6,000 | 96.2 | Ductile |

*Not measured due to irregular cross sections after testing.
Note: Strain rate for all tests was 500 to 550 in/in/min As may be seen from Table I and FIGS. 1*a*, 1*b* and 1*c*, the material processed in accordance with the invention (HIP) demonstrated significantly improved workability over the conventional ingot cast material (Cast). Specifically with regard to FIGS. 1*a*, 1*b* and 1*c*, in each of the FIGS. is shown a fractured, rapid-strain-rate tensile specimen produced conventionally as described above and identified as "Cast"; for comparison therewith there is shown an identical specimen prepared as described above in accordance with the practice of the invention and described as "HIP". In each instance the cast specimen shows considerably less elongation and reduction of area than the "HIP" specimen, regardless of the test temperature which ranged from 1600° to 2000° F. The hot workability as demonstrated by the elongation and reduction of area of the conventional "Cast" specimen was, as may be noted from FIG. 1*a*, so slight that meaningful measurements could not be made. With respect to the "Cast" specimens of FIGS. 1*b* and 1*c*, the fractures were irregular so that a meaningful measurement of reduction of area could not be made. Likewise, in each instance of FIGS. 1*a*, 1*b* and 1*c*, the observed elongation of the "HIP" specimen was significantly greater than that of the "Cast" specimen, which further illustrates the drastic improvement in hot workability resulting from the practice of the invention. As will be demonstrated hereinafter, this improved workability permits the production of iron-silicon alloys having silicon contents significantly higher than conventional, e.g. 5 to 10% silicon.

The effect of adding nickel and/or cobalt to iron-silicon alloys containing higher than conventional silicon contents with respect to resistivity and hot rollability are shown in Table II.

TABLE II

EFFECT OF COMPOSITION ON RESISTIVITY AND HOT ROLLABILITY

| Alloy | Composition (%) | Resistivity ohm-cm $\times 10^{-6}$ | 2000° F. Rolling Reduction Before Crack Formation (%) |
|---|---|---|---|
| SM-5 | Fe—3.3Si* | 46 | — |
| SM-9 | Fe—6.5Si | 84 | 42 |
| SM-10 | Fe—6.5Si—2Ni | 79 | 55 |
| SM-11 | Fe—6.5Si—4Ni | 80 | 44 |
| SM-12 | Fe—6.5Si—6Ni | 112 | 24 |
| SM-13 | Fe—6.5Si—2Co | 92 | 45 |
| SM-14 | Fe—6.5Si—4Co | 125 | 44 |
| SM-15 | Fe—6.5Si—6Co | 112 | 26 |
| SM-16 | Fe—5.0Si—1.5Al | 90 | 56 |
| SM-17 | Fe—5.0Si—1.5Al—2Ni | 93 | 73 |
| SM-18 | Fe—5.0Si—1.5Al—4Ni | 91 | 25 |
| SM-19 | Fe—5.0Si—1.5Al—6Ni | 130 | 25 |
| SM-20 | Fe—5.0Si—1.5Al—2Co | 91 | 25 |
| SM-21 | Fe—5.0Si—1.5Al—4Co | 87 | 25 |
| SM-22 | Fe—5.0Si—1.5Al—6Co | 99 | 26 |
| SM-2 | Fe—5.0Si—1.5Al—.68Ti—.32B | 80 | 76** |
| SM-3 | Fe—9.5Si—5.5Al | 81 | 25 |

*Published value for conventionally produced nonoriented 96Fe—4Si and grain-oriented 97Fe—3Si are 47 and 50 micro-ohms, respectively.
**No cracks.

The improved resistivity of Alloy SM-9 having 6.5% silicon over Alloy SM-5 having a conventional silicon content of 3.3% is almost two-fold. If nickel is added to the 6.5% silicon containing alloy in amounts of 2, 4 and 6% nickel, as shown in Table II, resistivity is progressively improved; however, if nickel is increased above 4% hot rolling is significantly impaired to indicate that an upper limit for nickel is about 4%. Likewise, if cobalt is added to a 6.5% iron-silicon alloy in amounts of 2%, 4% and 6%, above about 4% cobalt the resistance to cracking during hot rolling is significantly impaired. As shown by Alloys SM-17, SM-18 and SM-19, if to an iron-silicon alloy having 5% silicon and 1.5% aluminum nickel is added in amounts of 2%, 4% and 6%, respectively, hot workability is impaired at a nickel content of about 3%. Likewise as demonstrated by Alloys SM-20, SM-21 and SM-22, if cobalt is added to an iron-silicon alloy containing 5% silicon and 1.5% aluminum hot workability is impaired at a cobalt content exceeding about 1.5%. In general, therefore, the hot workability of iron-silicon alloys is decreased at higher levels of nickel and cobalt in the presence of higher than normal silicon contents. More specifically, as may be seen from the data presented in Table II, optimum combinations of resistivity and hot workability were obtained with Alloys SM-2 having 6.5% silicon and 2% nickel and SM-14 having 6.5% silicon and 4% cobalt, as well as the Alloy SM-17 having 5% silicon, 1.5% aluminum and 2% nickel. As a further demonstration of the beneficial effects of the invention with respect to hot workability on high-silicon containing iron-silicon alloys reference should be made to Alloy SM-3 in Table II. This alloy contained 9.5% silicon in combination with 5.5% aluminum and when processed in accordance with the invention was hot rolled at a reduction of 25% without exhibiting cracking.

The effect of adding nickel and increasing silicon in iron-silicon alloys with respect to the improvement in electrical properties, specifically coercive force, is shown in Table III. Specifically, as shown in Table III both alloys were processed as described above in accordance with the invention and tested to determine coercive force both before and after annealing. Alloy RST-SM-7 having 6.5% silicon and 2% nickel shows a significant improvement with respect to coercive force both before and after annealing with respect to Alloy RST-SM5 having 3.3% silicon and no nickel. After annealing, Alloy RST-SM7 had a coercive force value that was less than half of that of Alloy RST-SM5.

TABLE III

EFFECT OF COMPOSITION AND ANNEAL

| | | Coercive Force, Oe | |
|---|---|---|---|
| | | Before Anneal | After Anneal** |
| RST-SM5* | 3.3% Si, Bal Fe | 1.21 | 0.5 |
| | | 1.09 | 0.35 |
| RST-SM7 | 6.5% Si, 2% Ni, Bal Fe | 0.6 | 0.18 |
| | | 0.8 | 0.20 |
| | | 0.85 | 0.25 |

*Coercive force for conventional nonoriented annealed Fe—4% Si iron is 0.5 Oe.
**Anneal - 1200° C., 1 hr, cool at 16° C./min. to 690° C., hold 4 hrs, oil quench.

Table IV and FIG. 2 compare the core loss values for Alloy SM-7 (6.5% Si, 2% Ni, Bal. Fe) produced in accordance with the method of the invention as described above with conventional iron-silicon alloys having silicon contents of 3.3% and 4% in sheet thicknesses of 0.014 inch. As may be seen from Table IV and FIG. 2 the core loss as expressed in watts/lb. of nonoriented RST-SM7 is significantly superior to conventional nonoriented iron-silicon alloys having silicon contents of 3.3% and 4%. The core loss comparisons for Alloy RST-SM7, which was produced in accordance with the invention and grain-oriented conventional iron-silicon alloy having 3.3% silicon were single strip tests at the three induction levels listed on Table IV. The values for the conventional nonoriented iron-silicon alloy having 4% silicon are typical values for steel of this composition as reported in the literature. The improved core loss values of the invention would result in a significant improvement with regard to performance in electrical applications, including power transformer applications.

TABLE IV

Core Loss Comparisons at Various Inductions, 60 Cycles

| | Watts/lb | | |
|---|---|---|---|
| Induction, Gauss | Grain Oriented Silicon Steel Fe—3.3% Si (.014"t) | Nonoriented SM-7 Fe—6.5 Si—2 Ni (.014"t) | Nonoriented Silicon Steel Fe—3.3% Si (.014"t) |
| 10,000 | 0.249 | 0.299 | 0.58 |
| 12,000 | 0.357 | 0.416 | 0.80 |
| 14,000 | 0.49 | 0.48 | 1.18 |

As described above, conventional iron-silicon alloys for electrical applications are produced by hot rolling to an intermediate gauge followed by cold rolling to final gauge, which cold rolling involves a plurality of cold rolling operations with intermediate anneals. In accordance with the invention the alloy may be hot rolled to an intermediate gauge with hot rolling being conducted at a temperature within the range of 1600° to 2100° F., which is less than conventional hot rolling temperatures. Thereafter, rolling to final gauge is conducted at an elevated temperature of 700° to 1000° F., as opposed to conventional cold rolling to final gauge. Hence, by the practice of the invention higher than conventional silicon contents, and improved core loss values, are achieved while permitting rolling to gauges conventionally achieved in the production of iron-silicon sheet for electrical applications.

Hot isostatic compacting in accordance with the method of the invention may be performed in a gas-pressure vessel, commonly termed an autoclave. Pressures within the range of 5,000 to 15,000 psi may be used within a temperature range of 1800° to 2300° F., with pressure and temperature generally varying inversely. Other methods of hot compaction could also be used, e.g. mechanical hot pressing by extrusion, hot pressing, hot rolling, etc.

We claim:

1. A method for producing iron-silicon alloy articles having an improved combination of hot-workability and electrical properties, particularly resistivity, said method comprising producing a molten alloy mass of an iron-silicon alloy from which said article is to be made, gas atomizing said molten alloy mass to form prealloyed particles, rapidly cooling to solidify said particles, hot compacting said particles to form a fully dense article and hot rolling said fully dense article to form sheet.

2. The method of claim 1 wherein said alloy particles were cooled at a rate of about 100° to 100,000° C. per second.

3. The method of claim 2 wherein said alloy particles are within the size range of about 800 to less than 50 microns.

4. The method of claim 3 wherein said iron-silicon alloy has a silicon content within the range of 5 to 10% by weight.

5. The method of claim 4 wherein said iron-silicon alloy has a nickel content of up to 4% by weight.

6. The method of claim 4 wherein said iron-silicon alloy has a cobalt content of up to 4% by weight.

7. The method of claim 6 wherein said iron-silicon alloy has a nickel content of up to 4% by weight.

8. The method of claim 1 wherein said iron-silicon alloy has at least one grain boundary pinning agent selected from the group consisting of titanium boride, manganese sulfide and titanium sulfide.

9. The method of claim 4 wherein said iron-silicon alloy has an aluminum content within the range of 1.5 to 6% by weight.

10. A method for producing an iron-silicon alloy laminate suitable for use in the manufacture of a transformer core, said method comprising producing a molten alloy mass of an iron-silicon alloy from which said laminate is to be made and having a silicon content within the range of 5 to 10% by weight, gas atomizing said molten alloy to form prealloyed particles, cooling to solidify said particles at a cooling rate of about 100° to 100,000° C. per second, hot compacting said particles to form a fully dense article and hot rolling said article to form a sheet.

11. The method of claim 10 wherein said hot compacting is hot isostatic compacting.

12. The method of claim 10 wherein said iron-silicon alloy has a nickel content of up to 4% by weight.

13. The method of claim 12 wherein said iron-silicon alloy has a cobalt content of up to 4% by weight.

14. The method of claim 13 wherein said iron-silicon alloy has a nickel content of up to 4% by weight.

15. The method of claim 10 wherein said iron-silicon alloy has at least one grain boundary pinning agent selected from the group consisting of titanium boride, manganese sulfide and titanium sulfide.

16. The method of claim 10 wherein said iron-silicon alloy has an aluminum content within the range of 1.5 to 6% by weight.

17. The method of claim 10 wherein said hot rolling is performed in two operations with the first rolling operation being at a higher temperature than the second rolling operation.

18. The method of claim 17 wherein said sheet is hot rolled to a thickness of 0.2 to 0.009 inch.

19. The method of claim 17 wherein said first hot rolling operation is conducted at a temperature within the range of 1600° to 2100° F. and said second hot rolling operation is conducted at a temperature within the range of 700° to 1000° F.

* * * * *